US007707915B2

(12) United States Patent
Fordice

(10) Patent No.: US 7,707,915 B2
(45) Date of Patent: May 4, 2010

(54) DOUBLE ACTING SPANNER WRENCH

(75) Inventor: Robert D. Fordice, Shoreline, WA (US)

(73) Assignee: The Boeing Company, Chicago, IL (US)

( * ) Notice: Subject to any disclaimer, the term of this patent is extended or adjusted under 35 U.S.C. 154(b) by 37 days.

(21) Appl. No.: 12/044,661

(22) Filed: Mar. 7, 2008

(65) Prior Publication Data

US 2008/0216614 A1 Sep. 11, 2008

Related U.S. Application Data

(60) Provisional application No. 60/905,675, filed on Mar. 7, 2007.

(51) Int. Cl.
*B25B 13/30* (2006.01)

(52) U.S. Cl. ..... 81/57.32; 81/176.3

(58) Field of Classification Search ..... 81/176.3, 81/57.22, 57.32, 57.36, 57.38, 57.34, 395, 81/387–390, 77, 484
See application file for complete search history.

(56) References Cited

U.S. PATENT DOCUMENTS 1,413,362 A * 4/1922 Slattery ..... 81/98
3,292,465 A * 12/1966 Mulligan ..... 81/176.3
4,718,317 A * 1/1988 Hensler ..... 81/176.3
5,062,326 A * 11/1991 Goldschmidt ..... 81/57.32
5,546,833 A * 8/1996 Holdeman et al. ..... 81/52
6,931,965 B1 * 8/2005 Fanguy et al. ..... 81/57.36

* cited by examiner

*Primary Examiner*—D. S Meislin
(74) *Attorney, Agent, or Firm*—Steven R. Corey; Clifford G. Cousins; The Boeing Company

(57) ABSTRACT

An apparatus includes first and second coupling devices each having a lever end, a gripping end, and an elongated slot: an axle disposed within the elongated slot of each coupling device where the coupling devices may pivot relative to each other about the axle: a threaded shaft operatively attached to both a bushing pivotally disposed at the first coupling device lever end and a threaded seat pivotally disposed at the second coupling device lever end and configured to advance the lever ends toward each other as the threaded shaft is rotated in a first direction; and a pair of latches rotatably attached to a respective gripping end of a respective coupling device, each latch having a distal toe plate configured to engage a circumference of one of a pair of washers, the apparatus configured to tighten or loosen the pair of washers by imparting opposite rotational forces to the washers.

10 Claims, 3 Drawing Sheets

DOUBLE ACTING SPANNER WRENCH

CROSS REFERENCE TO RELATED APPLICATIONS

This application claims priority to U.S. Provisional Application Ser. No. 60/905,675 filed on 7 Mar. 2007 by Robert D. Fordice entitled "Helical Preload Washer Double Acting Spanner Wrench," the contents of which are incorporated herein by reference.

TECHNICAL FIELD

The embodiments described herein generally relate to tools and more specifically relates to tools that provide tightening or loosening forces to a pair of lock nuts or lock washers.

BACKGROUND

Helical or spiral washers are commonly used in pairs to preload threaded fittings on hydraulic actuators. Each washer has a flat surface, a helical surface, and notches along the outer circumference. The helical faces of the washers allow a preload force to be imparted on the threaded components with which they are assembled. Typically, two washers are installed with their helical faces opposing each other. As the washers are rotated in opposite directions against each other, the outer flat surfaces generate a preload force that prevents backlash during through-zero cyclic loading. This preload must be greater than the load generated by the actuator during test cycles to prevent backlash in the load linkage.

Tightening and loosening spiral washers can be labor intensive and time consuming on tests that use many hydraulic actuators. Specially designed spanner wrenches, one per spiral washer, are typically recommended for tightening or loosening the washers. Often the task has been accomplished using impact devices on the spanner wrenches, often resulting in damage to the washer and or the wrench. Such methods do not allow regulation of the amount of preload force applied to the threaded fasteners by the washers.

Although other techniques exist, all prove ineffective on the shop floor due to the magnitude of the forces required, the lack of a method to apply forces simultaneously to each washer, and the lack of a good way to hold one washer "still" while applying wrench forces on the other.

SUMMARY

In accordance with the disclosure, the problem of applying controllable, measurable forces to a pair of spiral washers is solved by an apparatus which imparts equal but opposite circumferential forces on two washers simultaneously. The circumferential forces are a function of a single input force or pressure controlled by an operator.

According to an embodiment, an apparatus includes first coupling device (12*a*) having a lever end (14), a gripping end (16), and an elongated slot (30); a second coupling device (12*b*) having a lever end (14), a gripping end (16), and an elongated slot (30); an axle (28) disposed within the elongated slot of each coupling device where the coupling devices (12*a*, 12*b*) are configured to pivot relative to each other about the axle: a threaded shaft (22) operatively attached to a bushing (24) pivotally disposed at the first coupling device lever end (14) and operatively attached to a threaded seat (25) pivotally disposed at the second coupling device lever end and configured to advance the lever ends (14) toward each other as the threaded shaft is rotated in a first direction; and a pair of latches (34), each latch being rotatably attached to a respective gripping end (16) of a respective coupling device (12*a*, 12*b*), each latch having a distal toe plate configured to engage a circumference of one of a pair of washers (18), the apparatus being configured to one of tighten or loosen the pair of washers by imparting opposite rotational forces to the washers.

The task of preloading threaded rod and cylinder ends can now be accomplished with one tool. The load factor can be precisely controlled with simple dial marks on the washers for visual reference; alternatively washer force can be controlled by using a torque wrench on the draw bolt. The fatigue factor and risk to technicians is greatly reduced by using the present invention over alternative means.

One of the advantages of the wrench is that it is easy to use and can simultaneously tighten or loosen two lock washers with respect to each other. Another advantage is that the wrench can be used to apply a measurable and repeatable torque to two spiral washers which, in turn, results a measurable and repeatable preload force.

Various embodiments of the wrench can be used to tighten or loosen helical lock washers, lock nuts, jam nuts, and collars which would otherwise require the use of two wrenches.

DETAILED DESCRIPTION OF THE INVENTION

Figure 1:
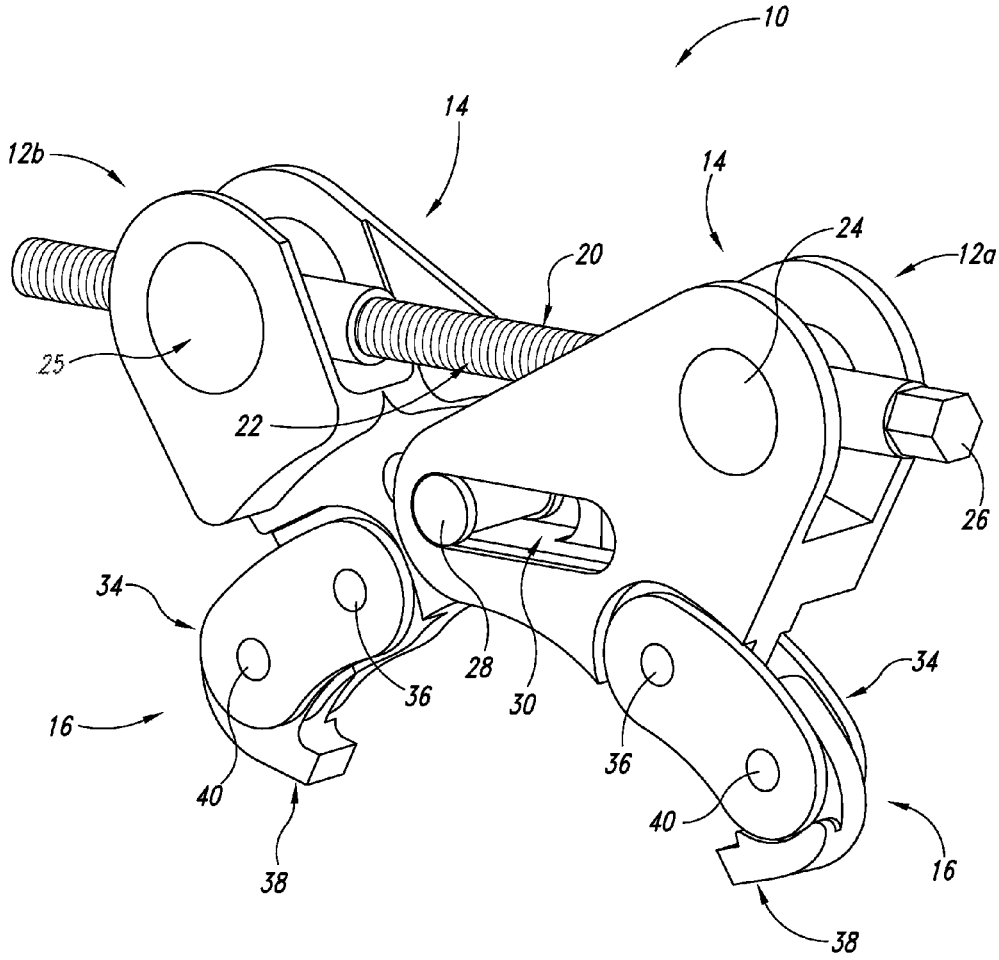
FIG. 1 is a perspective view of a spanner wrench according to a number of embodiments.
Figure 3:
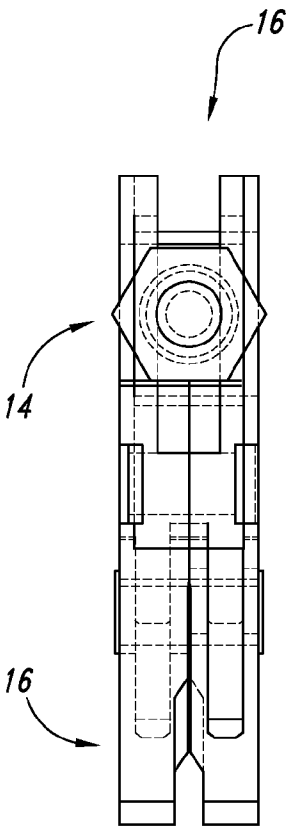
FIG. 3 is a side view of the wrench of FIG. 2.
Figure 2:
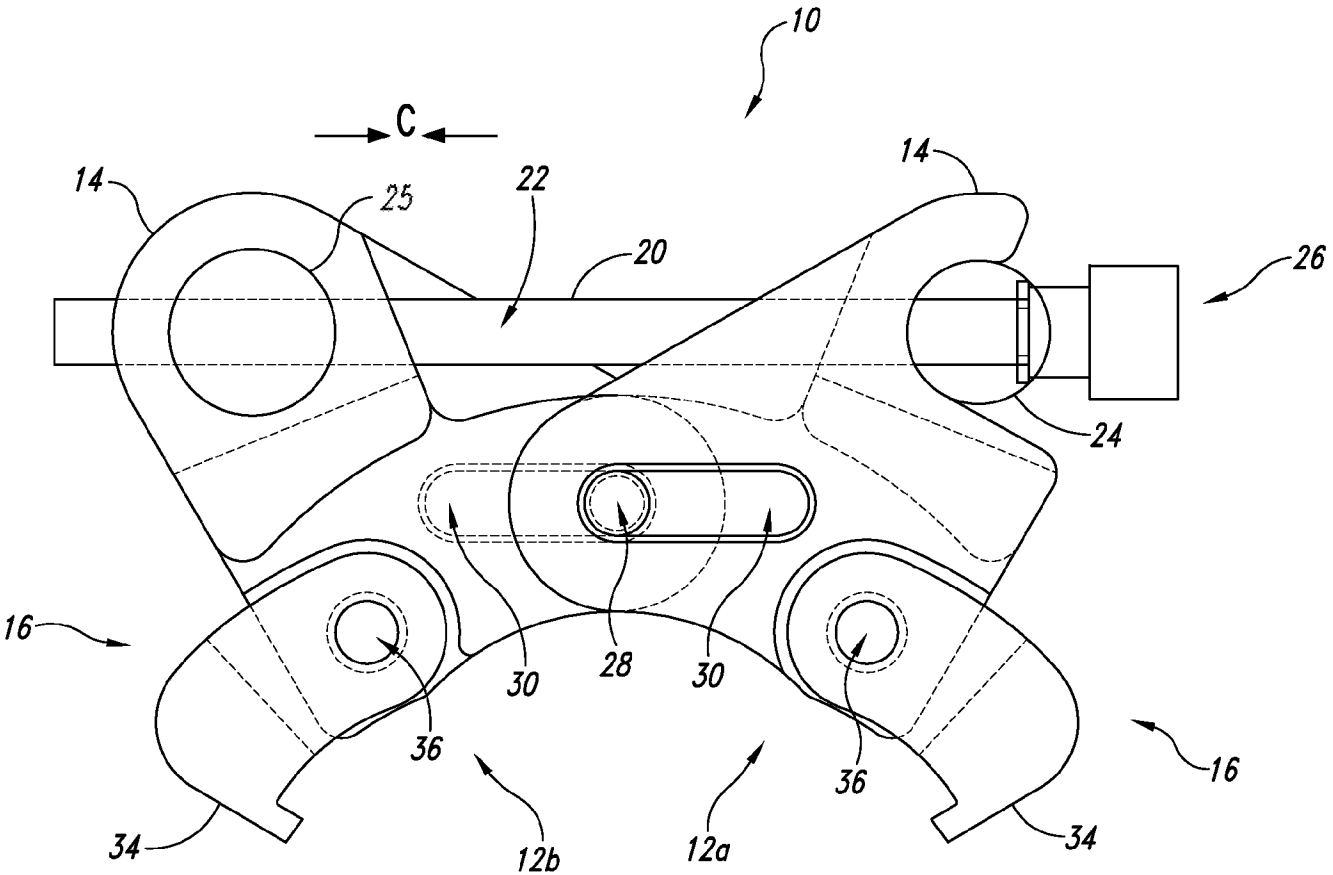
FIG. 2 is a top view of a spanner wrench according to other embodiments.

As shown in FIGS. 1, 2, and 3, various embodiments of a spanner wrench 10 for loosening or tightening washers are configured to impart opposite rotational forces to the washers, with the opposite rotational forces being a function of a single applied force. According to a number of embodiments, the wrench 10 may include a pair of coupling devices 12*a* and 12*b* each including a lever end 14 and a gripping end 16. The gripping ends 16 are adapted to engage a respective one of the washers 18, such as shown briefly in reference to FIG. 4. As shown, FIG. 1 illustrates an embodiment for loosening washers. As used herein, the term washer includes helical washers, spiral washers, lock nuts, jam nuts, and collars, and in particular washers with ramped or helical opposing faces. The predetermined loads generated between the washer faces may be equal to or greater than the loads encountered on the threaded features of a hydraulic actuator or hydraulic assembly.

As shown in FIG. 2. the coupling devices 12*a* and 12*b* are assembled such that when the respective gripping ends 16 engage respective washers 18, a squeezing force applied to the respective lever ends 14 as indicated by arrows C cause the washers 18 to rotate in opposite angular directions (e.g., clockwise and counterclockwise, respectively). FIG. 2 illustrates an embodiment for loosening washers. Each of the coupling devices 12*a* and 12*b* are preferably machined out of 15-5 stainless steel (SS) and heat treated to a minimum of 220 Kilo-pounds "Kips" Per Square Inch (KSI) minimum tensile strength.

In some of the embodiments, the squeezing force applied to the lever ends 14 may be applied by a lever device 20, also denoted as an upper drawbolt assembly 20, which is operatively attached to the lever ends 14 of each of the coupling devices 12*a*, 12*b*. For example, the lever device 20 may include a threaded shaft 22, also denoted a high strength drawbolt 22, that may be operatively engaged with a swivel bushing or thrust shoulder 24 pivotally disposed on the lever end 14 of a first coupling device 12*a* and threaded seat 25 pivotally disposed on the lever end 14 of second coupling device 12*b*. The threaded seat 25 has a mating thread to the shaft 22, while the bushing 24 is not threaded. The shaft 22 may have a nut 26 disposed on one end thereof for engaging with a complementary tool. As the shaft 22 is turned in a clockwise direction as viewed from nut 26 the lever ends 14 of first and second coupling devices are advanced towards each other. The bushing 24 and threaded seat 25 may also be denoted as swivel joints and are preferably made out of manganese bronze, and drawbolt 22 is preferably made out of 15-5 stainless steel and heat treated to 220 KSI.

Accordingly, when the threaded shaft 22 is rotated clockwise, the lever ends 14 are drawn inwardly or toward each other, thereby tightening the wrench's grip on the washers 18 and rotating the washers 18 respectively engaged therewith in opposite rotational directions. And when the threaded shaft 22 is rotated counterclockwise, the lever ends 14 are urged outwardly or away from each other, thereby loosening the wrench's grip on the washers.

As shown in FIGs 1-4 the coupling devices 12*a* and 12*b* are operatively and pivotally attached to each other by, for example, an axle 28, also denoted as a guide pin 28, disposed in respective slots 30, also denoted as channels 30, formed in the devices 12*a* and 12*b*. Accordingly, when the shaft 22 is actuated, the lever ends 14 and the gripping ends 16 rotate about the axle 28, while the slots 30 allow translation of the axle 28 therein. The gripping ends 16 function as the interface between the wrench 10 and the washers 18 as left-hand or right-hand dog latches 34, also denoted as claws, and where each latch 34 has a distal toe plate 38 that is configured to engage with notches 32 on the circumference of the associated washer 18. The dog latches 34 are "hook" shaped parts that are preferably made from American Iron and Steel Institute (AISI) 4340 steel and heat treated to a minimum of 250 KSI. The dog latches 34 may swivel freely at the attached pivot point 36 assembled to the associated coupling device 12. Spherical bearings are a preferred solution to accommodate the helical motion of the washers. In this case, the spherical bearings allow the dog latches 34 to float parallel to the axis of rotation so the wrench is less prone to binding. The dog latches 34 may be attached to pivot point 36 directly or through a second swivel point 40 as a slip joint to accommodate different washer sizes. In many embodiments, the coupling devices 12*a* and 12*b* may be configured such that approximately 45 degrees of rotation about the axle 28 is enabled.

Figure 4:
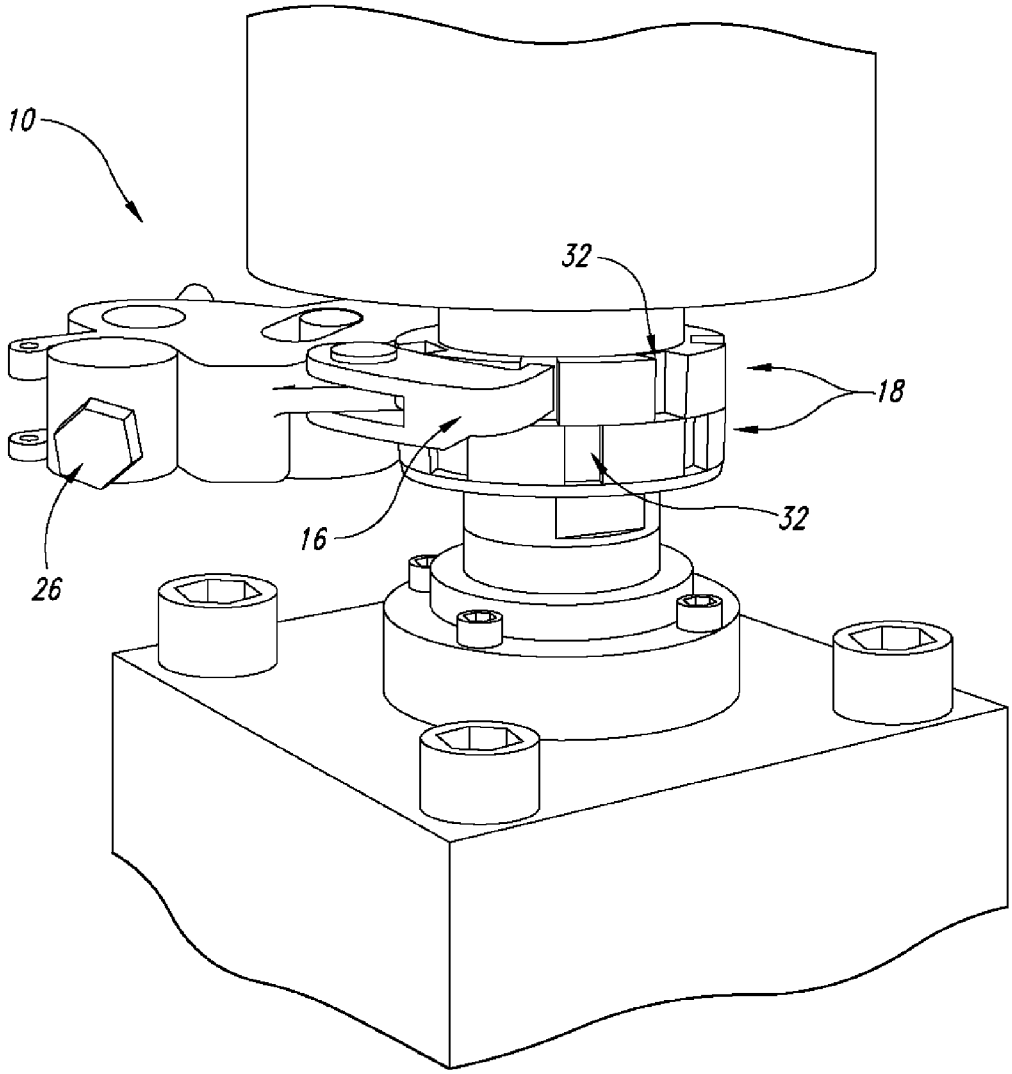
FIG. 4 illustrates an embodiment of the wrench in operation.

With reference to FIG. 4, in many applications, each of the washers 18 may include one or more annular notches 32. In such embodiments, the gripping end 16 of each of the coupling devices 12 may include a latch 34 configured to engage with the notches 32 of a respective one of the washers 18. As shown. FIG. 4 illustrates an embodiment for tightening helical or spiral washers because the gripping ends 16 and latches 34 are configured to engage with the washers 18 in a manner to advance them toward each other as they are moved in opposite rotational directions relative to each other. In this embodiment as shown in the two lever ends 14 are forced together by the threaded drawbolt assembly (20, 24, 25) resulting in the upper claw rotating the upper washer clockwise as viewed from the top portion of FIG. 4 and the lower claw rotating the lower washer counterclockwise for tightening. In another embodiment, where the claws are disposed on the opposite washers, when the two lever ends 14 are forced together by the threaded drawbolt assembly (20, 24, 25) resulting in the upper claw rotating the upper washer counter clockwise as viewed from the top portion of FIG. 4 and the lower claw rotating the lower washer clockwise for loosening. The applied motion of rotating the drawbolt 22 pulls the dog latches 34 towards each other in a pinching fashion. As the dog latches 34 are rotated together the washers they are engaged with expand on their opposing helical faces creating an outward force on the washers. The center guide pin 28 is spring loaded to allow the two halves of the wrench 10 to move apart as the wrench is tightened.

As shown in the embodiments of FIGS. 1 and 2, the dog latches 34 at their respective gripping ends 16 may be pivotally attached by respective axles 36. In addition, the latches may include a distal toe plate 38 configured to engage with the notches 32. As shown in the embodiment of FIG. 1, the toe plates 38 may be pivotally attached by respective axles 40. As shown, the first coupling device 12*a* includes an opening so the bushing or thrust shoulder 24 is not captive within the first coupling device 12*a*. In this manner, bushing 24 may be detached from engagement with the first coupling device 12*a*when the wrench is loosened.

While embodiments have been presented in the foregoing detailed description, it should be appreciated that a number of variations exist and applications exist. It should also be appreciated that the described embodiments are only examples and are not intended to limit the scope, applicability, or configuration of the described embodiments in any way. Rather, the foregoing detailed description will provide those skilled in the art with a convenient road map for implementing the exemplary embodiment or exemplary embodiments. It should be understood that various changes can be made in the function and arrangement of elements without departing from the scope as set forth in the appended claims and the legal equivalents thereof.

What is claimed is:

1. An apparatus (10), comprising:

a first coupling device (12*a*) having a lever end (14), a gripping end (16), and an elongated slot (30);

a second coupling device (12*b*) having a lever end (14), a gripping end (16), and an elongated slot (30);

an axle (28) disposed within the elongated slot of each coupling device where the coupling devices (12*a*, 12*b*) are configured to pivot relative to each other about the axle;

a threaded shaft (22) operatively attached to a bushing (24) pivotally disposed at the first coupling device lever end (14) and operatively attached to a threaded seat (25) pivotally disposed at the second coupling device lever end and configured to advance the lever ends (14) toward each other as the threaded shaft is rotated in a first direction; and a pair of latches (34), each latch being rotatably attached to a respective gripping end (16) of a respective coupling device (12*a*, 12*b*), each latch having a distal toe plate configured to engage a circumference of one of a pair of washers (18), the apparatus being configured to one of tighten or loosen the pair of washers by imparting opposite rotational forces to the washers.

2. The apparatus of claim 1, wherein each latch (34) attaches to a respective gripping end (16) at a single pivot point (36).

3. The apparatus of claim 1 wherein each latch (34) attaches to a respective gripping end (16) through a pivot point (36) and a distal swivel point (40) configured as a slip joint.

4. The apparatus of claim 1, wherein each washer includes at least one annular notch.

5. The apparatus of claim 1, wherein at least one of each coupling device (12*a*, 12*b*) and the threaded shaft is machined out of 15-5 stainless steel and heat treated to a minimum of 220 Kilo-pounds Per Square Inch "KSI" minimum tensile strength.

6. The apparatus of claim 1, wherein the bushing (24) and threaded seat (25) are made out of manganese bronze, and drawbolt 22 is preferably made out of 15-5 stainless steel and heat treated to 220 KSI.

7. The apparatus of claim 1, wherein the latches (34) are made from American Iron and Steel Institute "AISI" 4340 steel and heat treated to a minimum of 250 KSI.

8. The apparatus of claim 1, wherein the axle (28) is spring loaded.

9. A method of tightening or loosening washers, the method comprising:

applying a wrench (10) to a pair of washers (18) engaged on a hydraulic actuator, the wrench comprising: a first coupling device (12*a*) having a lever end (14), a gripping end (16), and an elongated slot (30); a second coupling device (12*b*) having a lever end (14), a gripping end (16), and an elongated slot (30); an axle (28) disposed within the elongated slot of each coupling device where the coupling devices (12*a*, 12*b*) are configured to pivot relative to each other about the axle; a threaded shaft (22) operatively attached to a thrust bearing (24) pivotally disposed at the first coupling device lever end (14) and operatively attached to a threaded seat (25) pivotally disposed at the second coupling device lever end and configured to advance the lever ends (14) toward each other as the threaded shaft is rotated in a first direction; and a pair of latches (34), each latch being rotatably attached to a respective gripping end (16) of a respective coupling device (12*a*, 12*b*), each latch having a distal toe plate configured to engage an annular notch (32) on the circumference of one of a pair of washers (18); and rotating the threaded shaft (22) in the first direction to impart opposite rotational forces to the washers to one of tighten or loosen the washers on the hydraulic actuator.

10. The method of claim 9, wherein a compressive force to the lever ends is provided by an operator-controlled torque to a draw bolt assembly (20) comprising the threaded shaft (22), the thrust shoulder (24), and the threaded seat (25).

* * * * *